US006688397B2

(12) United States Patent
McClurkin et al.

(10) Patent No.: US 6,688,397 B2
(45) Date of Patent: Feb. 10, 2004

(54) TECHNIQUE FOR EXPANDING TUBULAR STRUCTURES

(75) Inventors: Joel McClurkin, Houston, TX (US); Dennis L. Mills, Friendswood, TX (US); Craig D. Johnson, Montgomery, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 110 days.

(21) Appl. No.: 10/028,949

(22) Filed: Dec. 17, 2001

(65) Prior Publication Data

US 2003/0111234 A1 Jun. 19, 2003

(51) Int. Cl.[7] ..... E21B 43/10
(52) U.S. Cl. ..... 166/380; 166/207; 166/214
(58) Field of Search ..... 166/380, 206, 166/207, 208, 209, 210, 211, 212, 213, 214, 215, 216, 217

(56) References Cited

U.S. PATENT DOCUMENTS 3,414,055 A 12/1968 Vogt, Jr.
3,785,193 A 1/1974 Kinley et al.
5,318,121 A 6/1994 Brockman et al.
5,337,823 A 8/1994 Nobileau
5,348,095 A 9/1994 Worrall et al.
5,366,012 A 11/1994 Lohbeck
5,667,011 A 9/1997 Gill et al.
5,901,789 A 5/1999 Donnelly et al.
6,012,523 A 1/2000 Campbell et al.
6,021,850 A 2/2000 Wood et al.
6,029,748 A 2/2000 Forsyth et al.
6,070,671 A 6/2000 Cumming et al.
6,112,818 A 9/2000 Campbell
6,135,208 A 10/2000 Gano et al.
6,454,493 B1 * 9/2002 Lohbeck ..... 222/185.1
6,457,532 B1 * 10/2002 Simpson ..... 166/380

* cited by examiner

*Primary Examiner*—David Bagnell
*Assistant Examiner*—Jennifer R Dougherty
(74) *Attorney, Agent, or Firm*—Robert Van Someren; Jeffrey Griffin; Brigitte Jeffery Echols

(57) ABSTRACT

A system for expanding tubular structures. The system comprises a mandrel that is moved through the center of a tubular structure to increase the diameter of the tubular structure via deformation. The system utilizes an expansion device having a mandrel with multiple segments moved between a contracted state and an expanded state. In one embodiment, the mandrel segments are spring biased to permit a degree of independent movement of each mandrel segment with respect to the other mandrel segments.

52 Claims, 5 Drawing Sheets

TECHNIQUE FOR EXPANDING TUBULAR STRUCTURES

FIELD OF THE INVENTION

The present invention relates generally to a technique for expanding tubing, such as tubing utilized within wellbores, and particularly to a technique utilizing an expansion device moved through the tubing.

BACKGROUND OF THE INVENTION

A variety of devices are used to expand certain types of tubing from a smaller diameter to a larger diameter. Tubulars, such as those used within wellbores drilled for the production of desired fluids, are sometimes deformed within the wellbore. Typically, the tubing is moved to a desired wellbore location and then forced to a radially expanded condition with an expansion tool.

An exemplary existing expansion tool is a solid conical mandrel designed to be forced through the tubing to obtain the desired expansion. One problem occurs, however, when such devices must be moved through constrictions in the wellbore. The constriction potentially can impede or prohibit passage of the tool. Another problem can occur in attempting to expand the tubing to conform to "washouts" or other expanded regions in the wellbore. Existing tools are unable to conform to distorted tubular cross-sections. It would be advantageous to have a technique adapted to expand desired tubulars while allowing conformity to such perturbations within the wellbore.

SUMMARY OF THE INVENTION

The present invention features a technique for expanding a tubular structure, such as a tubular utilized in a wellbore environment. The technique utilizes an expansion mechanism that works in cooperation with the tubular structure to increase the diameter of the tubular structure upon placement at a desired location. The expansion device has an expandable mandrel that may be selectively actuated between a contracted state and an expanded state. The expansion device has a plurality of independently movable components that allow it to conform to a variety of cross-sectional configurations as it is moved through the tubular structure.

BRIEF DESCRIPTION OF THE DRAWINGS

The invention will hereafter be described with reference to the accompanying drawings, wherein like reference numerals denote like elements, and.

DETAILED DESCRIPTION OF EXEMPLARY EMBODIMENTS

The present technique utilizes an expansion device with a generally tubular section of material. The expansion device is moved through the tubular component to expand the diameter of the component. The technique may be beneficial in expanding numerous types of tubular components in a variety of environments, but for purposes of explanation the technique will be described in conjunction with the expansion of tubular components in wellbore environments. This explanation should not be construed as limiting, but the wellbore environment is one environment in which the present technique is of particular benefit. Also, the use of the term tubular should not be construed as limiting and generally applies to closed, elongate structures having a longitudinal opening therethrough. The cross-sectional configuration of a given tubular may have a variety of forms, such as circular, ovular, undulating, and other configurations.

Figure 1:
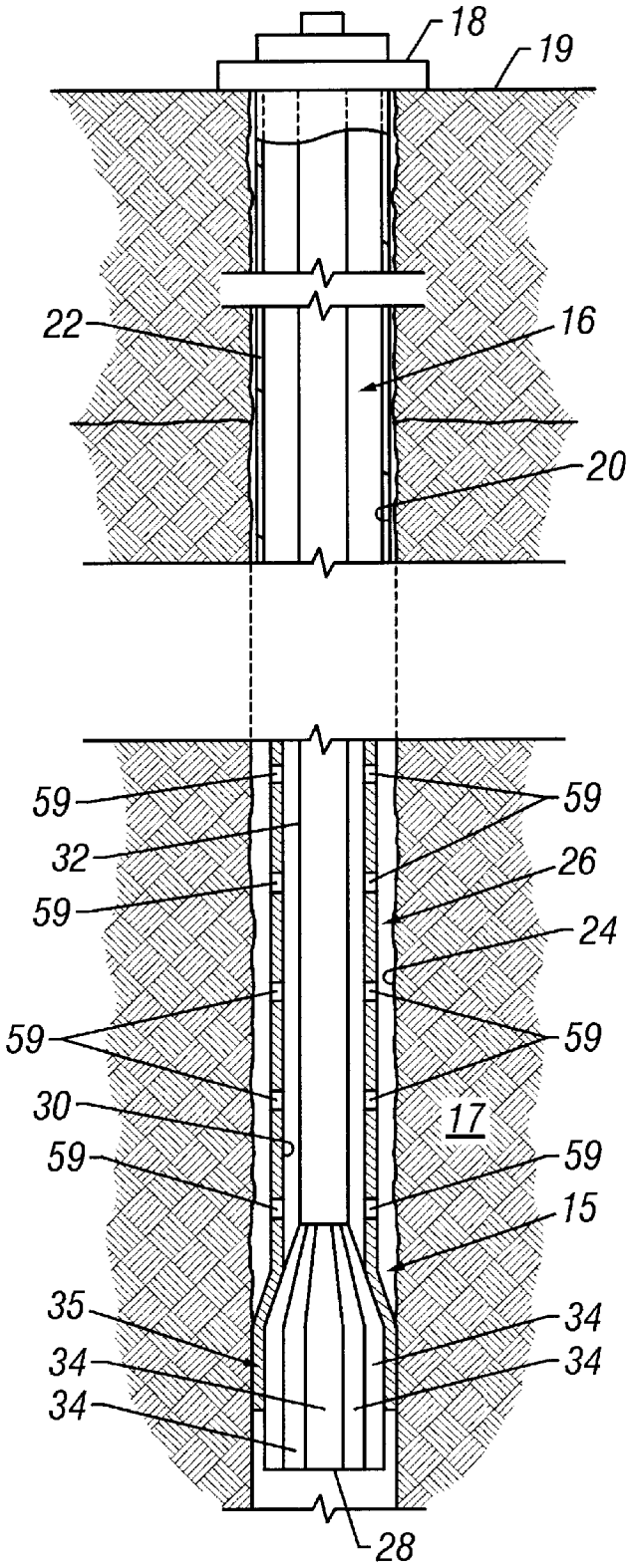
FIG. 1 is a front elevational view of an exemplary expansion system disposed within a wellbore.

Referring generally to FIG. 1, an exemplary expansion system 15 is illustrated according to one embodiment of the present invention. Expansion system 15 is disposed within a wellbore 16 formed in a subterranean, geological formation 17. In this particular application, wellbore 16 extends into geological formation 17 from a wellhead 18 disposed generally at a formation surface 19, such as the surface of the earth. Furthermore, wellbore 16 is defined by a wellbore surface 20 that may be lined with a liner 22. The wellbore 16 is illustrated as having a desired location 24 for receiving a tubular to be expanded on location.

Expansion system 15 generally comprises a tubular component 26 that may be deployed at desired location 24. The system further comprises an expansion device 28 capable of being moved through a generally central longitudinal opening 30 extending through tubular component 26. Expansion device 28 is pulled or pushed through longitudinal opening 30 by an appropriate mechanism 32, such as a tubing, cable or other mechanism.

The exemplary expansion device 28 is sufficiently compliant to accommodate certain deviations from uniform expansion of tubular component 26. Device 28 may be formed from a resilient material sufficiently stiff to expand tubular component 26 while being compliant enough to conform to deviations such as narrower regions or broader regions of the wellbore 16. In another embodiment, expansion device 28 comprises a plurality of movable portions 34 that form a mandrel 35. Movable portions 34 are independently movable to permit radial deformation of expansion device 28 and conformance to wellbore constrictions, expanded regions and a variety of wellbore abnormalities.

Additionally, mandrel 35 may be designed with movable portions 34 positioned to expand tubular component 26 upon movement therethrough or, alternatively, with movable portions 34 actuable between a contracted state and an expandable state. In the latter design, mandrel 35 is actuated or moved between a contracted state in which movable portions 34 are at a radially inward position and an expanded state in which movable portions 34 are at a radially outward position.

Figure 2:
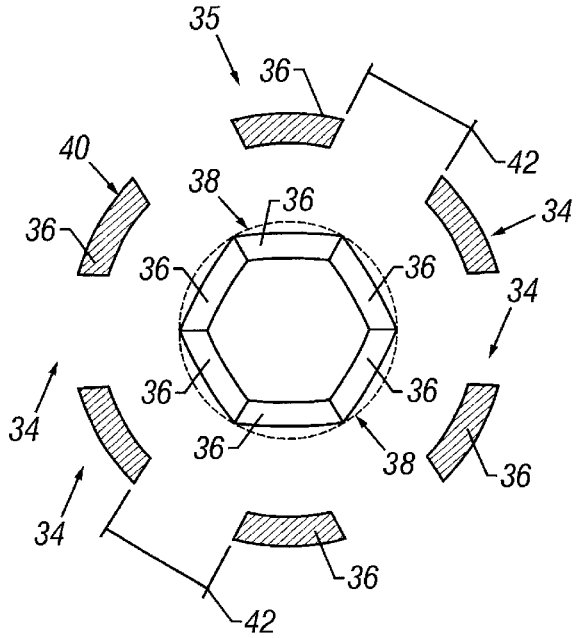
FIG. 2 is a schematic cross-sectional view of an exemplary mandrel utilized with the expansion system illustrated in FIG. 1.

Exemplary movable portions 34 are illustrated in FIG. 2. In this embodiment, movable portions 34 are in the form of segments or fingers 36 that may be moved between a contracted state 38 and an expanded state 40. As fingers 36 are moved from contracted state 38 to expanded state 40, spaces 42 are formed between adjacent fingers. If needed, one or more additional expansion devices 28 can be connected in series to compensate for spaces 42. In one such embodiment, a following expansion device is rotated slightly with respect to the lead expansion device such that the expanded mandrel segments of the following device move along the same lineal path as spaces 42 of the lead device.

As explained more fully below, each of the fingers 36 are coupled to a compliance mechanism that may, for example, be a spring-loaded mechanism able to maintain the fingers in expanded state 40 while permitting individual fingers to flex or move radially inward against the biasing spring force. In this manner, mandrel 35 can comply with or accommodate, for example, constrictions in the wellbore. The system also may be designed such that a biasing spring force is maintained against the tubular component 26 even after the tubular is expanded against, for example, wellbore surface 20. This permits individual fingers 36 to force portions of tubular component 26 to a further expanded position to accommodate "washouts" or other expanded regions in wellbore 16.

Figure 4:
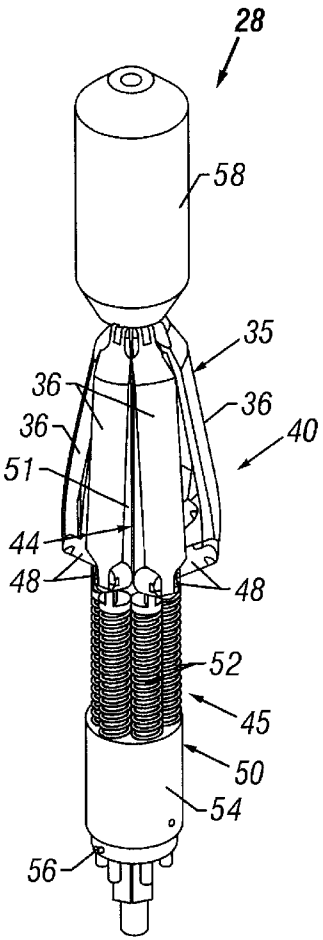
FIG. 4 is a perspective view of the expansion device of FIG. 3 in an expanded state.
Figure 3:
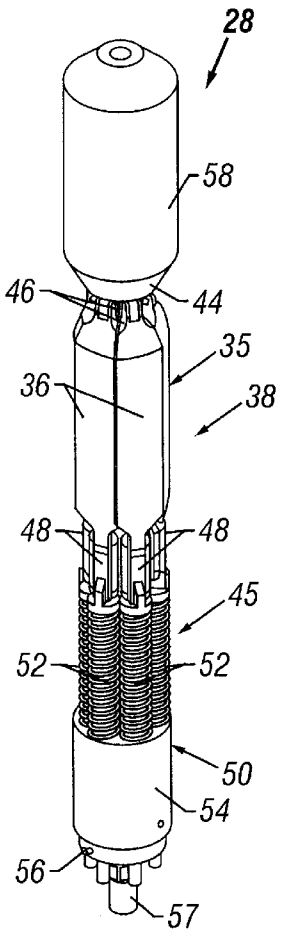
FIG. 3 is a perspective view of an exemplary expansion device in a contracted state.

One specific exemplary expansion device 28 is illustrated in FIGS. 3 and 4. In this embodiment, expandable mandrel 35 comprises fingers 36 that are movably mounted to a framework 44. For example, fingers 36 may be pivotably mounted to framework 44 for pivotable movement between contracted state 38 (FIG. 3) and expanded state 40 (FIG. 4). A compliance mechanism 45 is designed to maintain the fingers in expanded state 40 while permitting individual fingers to flex or move radially inward when moving past obstructions or other features that create cross-sectional variations in tubular component 26.

In the example illustrated, fingers 36 are independently pivotably mounted to framework 44 at a plurality of pivot ends 46 positioned such that fingers 36 trail pivot ends 46 when expansion device 28 is moved through tubular 26. Each finger 36 also is pivotably coupled to a link 48 at an end generally opposite pivot ends 46. Links 48, in turn, are pivotably coupled to an actuator 50 via compliance mechanism 45. In the illustrated embodiment, compliance mechanism 45 comprises a plurality of spring members 52, and each link 48 is coupled to a separate spring member 52. In this embodiment, each spring member 52 comprises a coil spring.

As actuator 50 moves in a generally axial direction along framework 44 towards pivot ends 46, links 48 force fingers 36 to pivot radially outwardly towards expanded state 40, as illustrated in FIG. 4. Actuator 50 securely holds mandrel 35 in this expanded state, while spring members 52 allow individual fingers 36 to be flexed or pivoted radially inwardly to accommodate changes in the cross-sectional configuration of tubular component 26. As mentioned previously, the expansion device 28 may be designed such that the freely expanded state of mandrel 35 has a larger diameter than the expanded diameter of tubular component 26. This permits individual fingers 36 to provide a radially outward force that further expands certain portions of tubular component 26 so as to deform the tubular into further expanded regions.

Also, the system may be designed without an actuator 50. For example, compliance mechanism 45 can be coupled to framework 44 to hold fingers 36 in a radially outward position. In this embodiment, expansion device 28 typically is deployed with tubular 26 and then moved therethrough to expand the tubular component.

If movement of the mandrel between a contracted state and an expanded state is desired, a variety of actuators 50 may be used. For example, the actuator may be designed to move radially, such that it directly forces movable portions 34 in a radially outward direction. Alternatively, actuator 50 may be designed for linear movement directed against appropriate linkages that expand mandrel 35 in a radially outward direction, as in the embodiment illustrated in FIGS. 3 and 4. Additionally, actuator 50 may be actuated in a variety of ways including mechanically, pneumatically and hydraulically. For example, actuator 50 may comprise a hydraulic piston 54 that is expanded or contracted in a lineal direction. Piston 54 is moved via a hydraulic fluid pumped into actuator 50 or removed from actuator 50 via a hydraulic port 56 fed by an appropriate hydraulic line (not shown).

Framework 44 also may comprise a variety of configurations. In the example illustrated, framework 44 comprises an elongate portion 57, such as a shaft. Elongate portion 57 is coupled to a connector 58 which, in turn, is designed for coupling to mechanism 32 utilized in pulling expansion device 28 through tubular component 26. Alternatively, connector 58 can be placed at an opposite end of framework 44 to permit pushing of expansion device 28 through tubular component 26 via mechanism 32. In the particular embodiment illustrated, connector 58 has a diameter approximately equal to or slightly larger than the diameter of mandrel 35 when in contracted state 38. Thus, connector 58 provides some protection of expansion device 28 during deployment and removal.

In certain applications, tubular 26 comprises at least one and typically a plurality of openings 59. Sometimes, openings 59 are designed as bistable cells formed through the wall of tubular component 26. The bistable cells are stable when oriented in either a contracted state or an expanded state. The use of such cells can facilitate expansion of the tubular. Openings 59, whether bistable or not, permit tubular 26 to be designed as a sandscreen for use in a wellbore.

Figure 5:
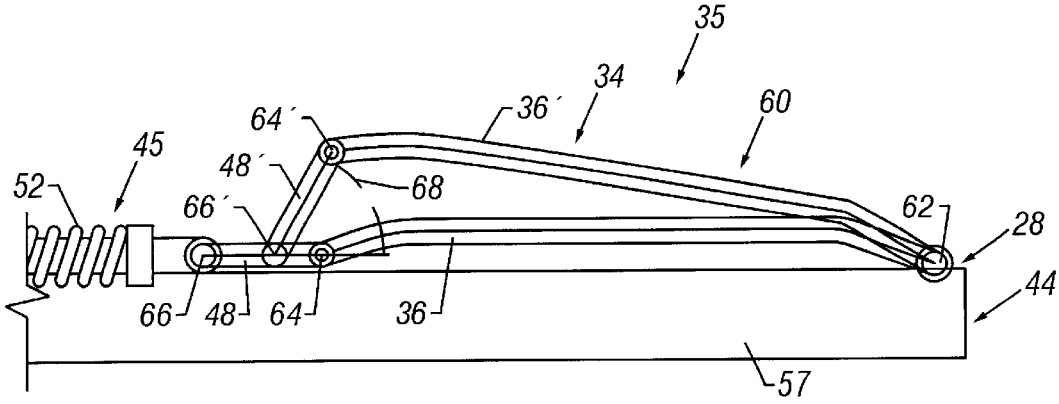
FIG. 5 is a partial cross-sectional view taken generally along the axis of the expansion device to illustrate one embodiment of an expansion component.

The conversion of lineal motion induced by actuator 50 to radial motion of movable portions 34 can be achieved by a variety of mechanisms. In FIG. 5, a three-bar linkage 60 is illustrated. The three-bar linkage 60 is basically the linkage configuration of the embodiment illustrated in FIGS. 3 and 4.

In this embodiment, each finger 36 forms a portion of the three-bar linkage 60. For example, each finger 36 can be designed as one link of the three-bar linkage. Each link 48 forms another link of the three-bar linkage and elongate portion 57 forms the third link of three-bar linkage. Elongate portion 57 is coupled to link 48 through actuator 50 and the corresponding spring member 52.

As illustrated, finger 36 is pivotably coupled to framework 44 via a pivot 62, e.g. at pivot end 46. At an opposite end, finger 36 is pivotably coupled to link 48 at a second pivot 64. Spring member 52 is pivotably coupled to link 48 at a third pivot point 66. As spring member 52 is moved linearly towards pivot 62, link 48 is pivoted through an angle 68 to move finger 36 to its radially outlying or expanded position as indicated by finger 36', link 48', second pivot 64' and third pivot 66'.

Figure 6:
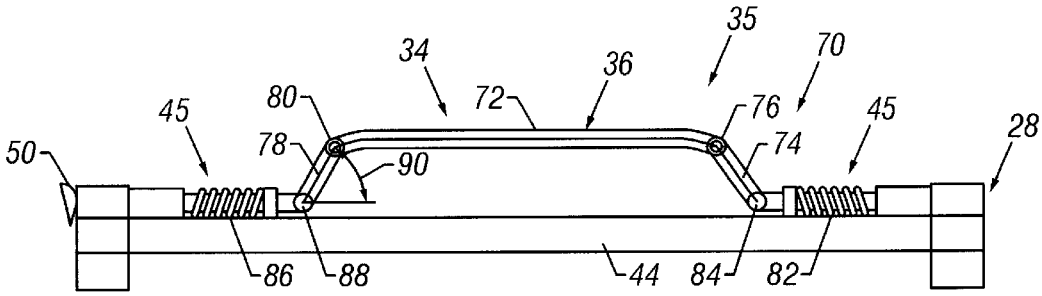
FIG. 6 is a partial cross-sectional view taken generally along the axis of the expansion device to illustrate an alternate embodiment of the expansion component.

An alternative system for expanding mandrel 35 is illustrated in FIG. 6. In this embodiment, the movable portion 34 is in the form of a segment or finger that forms a portion of a four-bar linkage 70. Four-bar linkage 70 has a radially outward link 72 designed to press against and expand the diameter of tubular component 26. Radially outward link 72 is pivotably coupled to a first connector link 74 via a pivot 76 and to a second connector link 78 via a pivot 80. First connector link 74 is pivotably coupled to a spring member 82 via a pivot 84, and spring member 82 is coupled to framework 44. Similarly, second link 78 is pivotably coupled to a spring member 86 via a pivot 88, and spring member 86 is ultimately connected to framework 44. In the example illustrated, spring member 86 is connected to framework 44 through actuator 50. However, actuator 50 can be designed for connection to one or both of spring members 82 and 86.

As spring member 86 is moved towards spring member 82, first connector link 74 and second connector link 78 move link 72 to its radially outward or expanded location, as illustrated in FIG. 6. Actuator 50 along with spring members 82 and 86 bias link 72 towards this radially outward position during movement through an appropriate tubular component. As with the designs discussed above, spring members 82 and 86 permit some independent radial movement of each link 72 to accommodate constrictions and/or areas of further radial expansion. When spring member 86 is moved in an axial direction away from spring member 82, links 74 and 78 are pivoted inwardly through an angle 90 until radially outward link 72 lies generally along framework 44.

Figure 7:
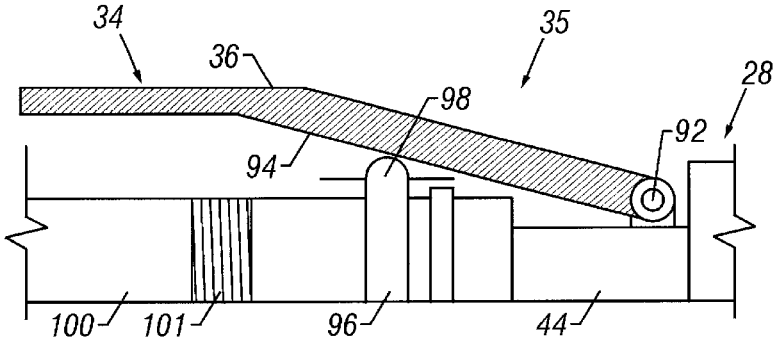
FIG. 7 is a partial cross-sectional view taken generally along the axis of the expansion device to illustrate another alternate embodiment of an expansion component.

Another embodiment of an expandable mandrel 35 is illustrated in FIG. 7. In this embodiment, a plurality of fingers 36 are pivotably coupled to framework 44 by corresponding pivots 92. Each finger 36 has an interior slide surface 94 designed for engagement with an expander 96. Expander 96 comprises a slide member 98 designed for sliding movement along surface 94. Additionally, expander 96 comprises a body 100 slidably mounted to framework 44. As actuator 50 (not shown in this Figure) moves body 100 and slide member 98 towards pivot 92, slide member 98 is forced along surface 94. This movement pushes finger 36 to a radially outward position. Similarly, as slide member 98 is moved in a generally axial direction away from pivot 92, finger 36 moves radially inward to a contracted state.

Fingers 36 may be spring loaded by forming a portion of body 100 from a spring member 101 connected to slide member 98. The spring member 101 provides a spring bias against surface 94 such that fingers 36 are biased in a radially outward direction. Furthermore, slide member 98 may be made from a plurality of independent sections associated with corresponding independent fingers. A plurality of individual spring elements (not shown) are then used to permit a degree of independent movement of each finger 36 when external forces acting on that finger are either greater or less than the spring force biasing that particular finger in a radially outward direction.

Figure 8:
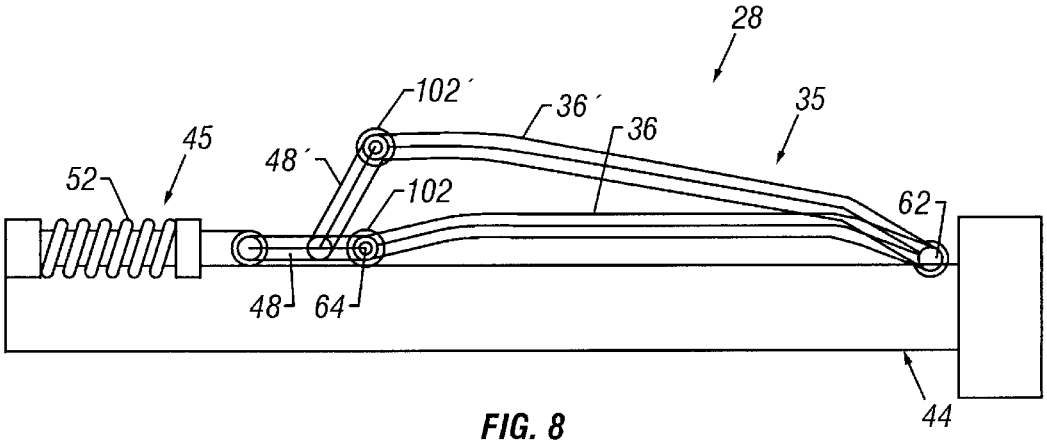
FIG. 8 is a view similar to that of FIG. 5 illustrating another alternate embodiment of the expansion component.

Other exemplary alternative embodiments are illustrated in FIGS. 8 through 11. In each of these figures, common reference numerals are used to label elements common with those illustrated in FIGS. 5 and 6. In FIG. 8, for example, a linkage system similar to that of FIG. 5 is illustrated. However, in this embodiment, a roller 102 (102' in the expanded state) is incorporated with each three-bar linkage. The rollers 102 facilitate movement of expansion device 28 through tubular 26. Each roller 102 is rotatably mounted about a corresponding second pivot 64 to rotate along the inside surface of tubular 26 as expansion device 28 is moved therethrough.

Figure 9:
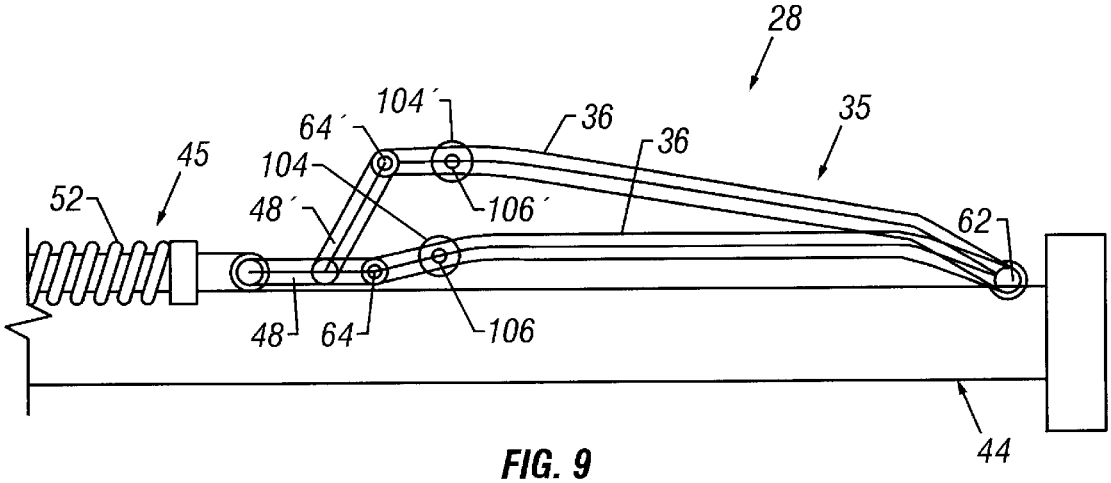
FIG. 9 is a view similar to that of FIG. 5 illustrating another alternate embodiment of an expansion component.

Rollers also may be mounted at other locations along expansion device 28. As illustrated in FIG. 9, for example, one or more rollers 104 (104' in expanded state) may be mounted along each segment 36 intermediate pivots 62 and 64. Each roller 104 is mounted to its corresponding segment 36 by an appropriate mounting pin 106. Roller 104 rotate with or about their corresponding mounting pins 106 to facilitate movement of expansion device 28 through tubular 26. It should be noted that rollers, such as rollers 102 and 104, can be incorporated into four-bar linkage systems and a variety of other types of mandrels 35.

Figure 10:
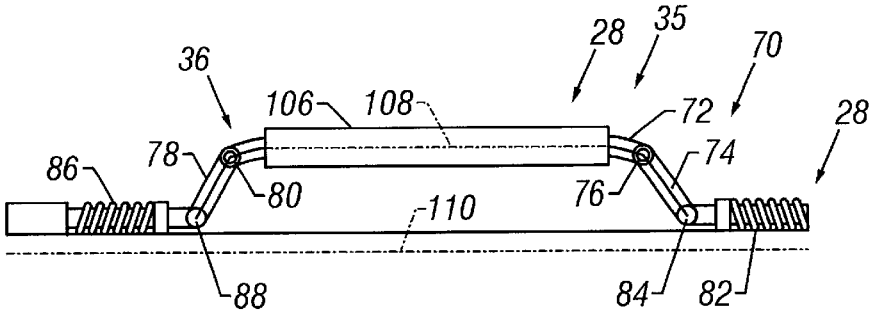
FIG. 10; is a view similar to that of FIG. 6 illustrating another alternate embodiment of the expansion component.

Additionally, rollers may be mounted in other orientations. As illustrated in FIG. 10, a roller 106 may be mounted for rotation around radially outward link 72 of four-bar linkage 70. In this type of embodiment, roller 106 rotates when expansion device 28 is rotated within tubular 26. In other words, rollers 106 facilitate the rotation of the overall expansion device within the tubular. This can be beneficial in a variety of applications to facilitate uniform expansion of the tubular, e.g. an expandable screen. In the specific embodiment illustrated, a roller axis 108 is generally parallel with a tool axis 110.

Figure 11:
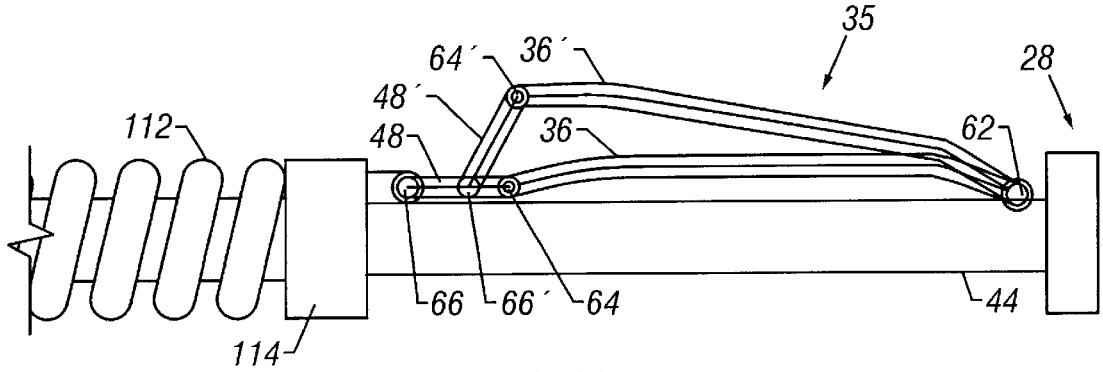
FIG. 11 is a view similar to that of FIG. 5 illustrating the connection of more than one expansion linkage to a single spring element.

In another alternate embodiment, mandrel 35 is designed such that two or more segments 36 are coupled to a single spring element. Thus, a single spring member 52 may be utilized to bias two or more segments 36 in a radially outward direction. In FIG. 11, for example, a single spring element 112 biases all of the mandrel segments 36 in a radially outward direction through a coupling member 114. Although the exemplary spring element 112 is in the form of a coil spring, a variety of other spring elements also can be utilized to place a spring load on segments 36.

Figure 12:
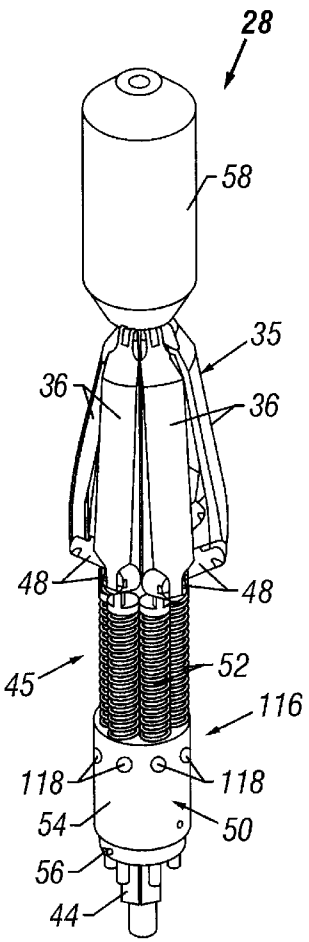
FIG. 12 is an alternate embodiment of the expansion device illustrated in FIG. 4.

As illustrated in FIG. 12, expansion device 28 also may be designed to incorporate a sensor system 116 having one or more types of sensors 118. For example, sensor system 116 may comprise a caliper measuring system that logs the inside diameter of an expanded tubular during installation of the tubular in a wellbore. This type of measurement provides valuable information with respect to the degree of tubular expansion, wellbore profile and risk areas where, for example, restrictions exist.

In one embodiment, the caliper system, e.g. system 116, comprises a series of displacement transducers, represented by sensors 118. The displacement transducers are coupled to individual segments, e.g. fingers, of expandable mandrel 35 to detect the movement of each segment. The displacement transducers are calibrated to provide a diameter measurement that is transmitted back to the surface via a wireline or recorded in one or more memory modules within expansion device 28.

It will be understood that the foregoing description is of exemplary embodiments of this invention, and that the invention is not limited to the specific forms shown. For example, the technique may be applied to a wide variety of tubulars, including liners, sandscreens, patches, etc; the expandable mandrel may comprise a variety of independent segments coupled to various forms of spring elements; the size of the expansion device and the materials used can be modified according to the specific application; and a variety of other linkages may be used for moving the mandrel segments between contracted and expanded states. These and other modifications may be made in the design and arrangement of the elements without departing from the scope of the invention as expressed in the appended claims.

What is claimed is:

1. A device for expanding a tubular structure, comprising:

a framework;

an expandable mandrel mounted to the framework; and an actuator to selectively move the expandable mandrel between a contracted state and an expanded state, wherein a spring member resists movement of the mandrel to the contracted state but renders the mandrel compliant when in the expanded state.

2. The device as recited in claim 1, wherein the expandable mandrel comprises a plurality of mandrel segments, each mandrel segment being pivotably coupled to the framework.

3. The device as recited in claim 2, wherein each mandrel segment may be at least partially pivoted independently.

4. The device as recited in claim 2, wherein each mandrel segment forms a portion of a three-bar linkage.

5. The device as recited in claim 2, wherein each mandrel segment forms a portion of a four-bar linkage.

6. The device as recited in claim 5, wherein each mandrel segment is spring loaded via a coil spring.

7. The device as recited in claim 2, further comprising a plurality of spring members coupled between the plurality of mandrel segments and the actuator, wherein lineal movement of the plurality of spring members causes radial movement of the plurality of mandrel segments.

8. The device as recited in claim 7, wherein the actuator is hydraulically actuated.

9. The device as recited in claim 2, further comprising a sliding expander disposed to slide along the plurality of mandrel segments and to force the mandrel segments in a radially outward direction.

10. The device as recited in claim 2, further comprising a sensor system.

11. The device as recited in claim 10, wherein the sensor system comprises a caliper measuring system.

12. The device as recited in claim 2, further comprising a plurality of rollers coupled to the plurality of mandrel segments.

13. A system for placing an expandable component at a desired location within a wellbore, comprising:

an expandable tubular; and an expansion device having a compliant mandrel to cause radial expansion of the expandable tubular during movement of the compliant mandrel therethrough, the compliant mandrel having a spring member positioned to resist radial contraction of the mandrel while being adaptable to variations in cross-section of the expandable tubular.

14. The system as recited in claim 13, wherein the compliant mandrel comprises a plurality of fingers independently movable in a generally radial direction.

15. The system as recited in claim 14, wherein each finger of the plurality of fingers is pivotably mounted to a framework and spring biased against radially inward movement.

16. The device as recited in claim 15, further comprising a plurality of rollers coupled to the plurality of fingers.

17. The system as recited in claim 14, wherein the compliant mandrel is selectively expandable and each finger forms a portion of a three-bar linkage.

18. The system as recited in claim 14, wherein the compliant mandrel is selectively expandable and each finger forms a portion of a four-bar linkage.

19. The system as recited in claim 14, wherein each finger is spring biased, via a coil spring, against radial contraction.

20. The system as recited in claim 14, further comprising a plurality of spring members coupled between the plurality of fingers and an actuator, wherein generally axial movement of the spring members via the actuator causes radial movement of the plurality of fingers.

21. The system as recited in claim 14, wherein the expandable tubular comprises a plurality of bistable cells.

22. The system as recited in claim 14, wherein the expandable tubular comprises a sandscreen.

23. The device as recited in claim 14, further comprising a sensor system.

24. The device as recited in claim 23, wherein the sensor system comprises a caliper measuring system.

25. A method of expanding a tubular component in a wellbore, comprising:

locating the tubular component at a desired location in the wellbore;

providing an expansion device having a plurality of movable portions able to conform independently of each other to various cross-sectional configurations of the tubular component; and moving the expansion device through the tubular.

26. The method as recited in claim 25, wherein providing comprises pivotably coupling a plurality of fingers to a framework to permit pivotable movement of the plurality of fingers.

27. The method as recited in claim 26, wherein providing further comprises connecting each finger to a spring member to provide a desired level of resistance to radially inward movement of the finger from the expanded state.

28. The method as recited in claim 27, further comprising expanding the expansion device from a contracted state to an expanded state.

29. The method as recited in claim 28, wherein expanding comprises moving an actuator against each spring member to force the plurality of fingers to pivot outwardly to the expanded state.

30. The method as recited in claim 28, further comprising forming each finger as part of a three-bar linkage.

31. The method as recited in claim 28, further comprising forming each finger as part of a four-bar linkage.

32. The method as recited in claim 25, wherein locating comprises locating a bistable tubular component.

33. The method as recited in claim 25, wherein moving comprises pulling the expansion device through the tubular component.

34. The method as recited in claim 25, wherein moving comprises pushing the expansion device through the tubular component.

35. The method as recited in claim 25, further comprising incorporating a plurality of rollers into the expansion device for rolling motion along the tubular component during expansion of the tubular.

36. A system of expanding a tubular component in a wellbore, comprising:

means for expanding the expansion device;

means for providing a spring bias against radial collapse of the expansion device while accommodating cross-sectional variations in the tubular component; and means for moving the expansion device through the tubular.

37. The system as recited in claim 36, wherein the means for providing comprises a plurality of spring-loaded fingers.

38. The system as recited in claim 37, wherein the means for expanding comprises an actuator movable in an axial direction to selectively adjust the plurality of spring-loaded fingers between an expanded state and a contracted state.

39. A device for expanding a tubular structure, comprising:

a framework;

a plurality of independent fingers;

an actuator to move the plurality of independent fingers between a contracted state and an expanded state; and a compliance mechanism coupled to the plurality of independent fingers to maintain the plurality of independent fingers in the expanded state while permitting differing degrees of radially inward movement of individual independent fingers.

40. The device as recited in claim 39, wherein the compliance mechanism comprises a spring member.

41. The device as recited in claim 39, wherein the compliance mechanism comprises a plurality of spring members.

42. The device as recited in claim 39, wherein each independent finger is part of a three-bar linkage.

43. The device as recited in claim 39, wherein each independent finger is part of a four-bar linkage.

44. A method of expanding a tubular, comprising:

drawing an expansion device through a tubular to expand the tubular; and accommodating deviations from uniform expansion of the tubular by a resilient member that resists radial collapse of the expansion device.

45. The method as recited as claim 44, wherein accommodating comprises expanding a first portion of the tubular to a first predetermined extent, and expanding a second portion of the tubular to a second predetermined extent in a single pass of the expansion device through the tubular.

46. The method as recited in claim 45, wherein accommodating comprises incorporating a plurality of independently movable fingers into the expansion device.

47. The method as recited in claim 44, wherein accommodating comprises contouring the shape of the tubular to the shape of a non-uniform surrounding surface.

48. The method as recited in claim 44, wherein accommodating comprises forming the tubular around obstructions that limit outward expansion.

49. The method as recited in claim 44, wherein accommodating comprises expanding certain sections of the tubular more than others.

50. The method as recited in claim 44, wherein accommodating comprises incorporating a plurality of independently movable fingers into the expansion device.

51. The method as recited in claim 50, further comprising actuating the plurality of independently movable fingers between a contracted state and an expanded state.

52. The method as recited in claim 51, further comprising spring biasing the fingers against radially inward movement when in the expanded state.

* * * * *